US011268403B2

(12) United States Patent
Chohan et al.

(10) Patent No.: US 11,268,403 B2
(45) Date of Patent: Mar. 8, 2022

(54) GAS TURBINE ENGINE INDUCTION SYSTEM, CORRESPONDING INDUCTION HEATER AND METHOD FOR INDUCTIVELY HEATING A COMPONENT

(71) Applicant: Siemens Aktiengesellschaft, Munich (DE)

(72) Inventors: Harry Chohan, Pointe-Claire (CA); Sébastien Bouffard, Verdun (CA); Alexandre Malo, Vaudreuil-Dorion (CA); Hayden Smith, Saint-Laurent (CA)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/771,726

(22) PCT Filed: Jan. 5, 2018

(86) PCT No.: PCT/US2018/012535
§ 371 (c)(1),
(2) Date: Jun. 11, 2020

(87) PCT Pub. No.: WO2019/135760
PCT Pub. Date: Jul. 11, 2019

(65) Prior Publication Data

US 2021/0189906 A1 Jun. 24, 2021

(51) Int. Cl.
*F01D 25/14* (2006.01)
*F01D 25/10* (2006.01)

(52) U.S. Cl.
CPC ..... *F01D 25/14* (2013.01); *F01D 25/10* (2013.01); *F05D 2220/32* (2013.01); *F05D 2240/14* (2013.01); *F05D 2260/20* (2013.01)

(58) Field of Classification Search
CPC ..... F01D 25/10
See application file for complete search history.

(56) References Cited

U.S. PATENT DOCUMENTS

| | | | | |
|---|---|---|---|---|
| 9,404,380 | B2 * | 8/2016 | Welch | F01D 11/24 |
| 2014/0321984 | A1 | 10/2014 | Welch et al. | |
| 2015/0377054 | A1 | 12/2015 | Mizukami et al. | |

FOREIGN PATENT DOCUMENTS

| | | | |
|---|---|---|---|
| EP | 2333248 | A1 | 6/2011 |
| EP | 2754859 | A1 | 7/2014 |
| GB | 2103718 | A | 2/1983 |

OTHER PUBLICATIONS

PCT International Search Report and Written Opinion of International Searching Authority dated Aug. 27, 2018 corresponding to PCT International Application No. PCT/US2018/012535 filed Jan. 5, 2018.

* cited by examiner

*Primary Examiner* — Richard A Edgar
*Assistant Examiner* — John S Hunter, Jr.

(57) ABSTRACT

An induction heater is employed with a gas turbine engine in order to heat a static component of the gas turbine engine. The heating of the static component is performed prior to the ignition of the gas turbine engine and during transient conditions. This minimizes thermal differences between the components of the gas turbine engine during transient conditions to thereby increase the life span of the components.

6 Claims, 3 Drawing Sheets

GAS TURBINE ENGINE INDUCTION SYSTEM, CORRESPONDING INDUCTION HEATER AND METHOD FOR INDUCTIVELY HEATING A COMPONENT

BACKGROUND

1. Field

Disclosed embodiments are generally related to turbine engines, and in particular to applying induction heating to engine components during start up.

2. Description of the Related Art

The increased use of low cost renewable power generation has created a growth market for gas turbine engines as back-up or make-up power solutions. One of the limitations to how fast a gas or steam turbine engine can start or respond to changes in load demand are the thermal stresses in large gas turbine engine components, such as casings. As the gas turbine engine starts, internal surfaces are heated. The components closer to the gas path or with lower thermal inertia, such as thin casings or struts will heat faster than bulky outer casings. The thermal gradients within these components create thermal stresses, which if not effectively managed can result in material weaknesses and potential damage.

In order to address these thermals differences, acceleration rate limits or load step limits are implemented. These limits can impact the performance of the gas turbine engine. The thermal stresses can be reduced by pre-heating large static components prior to start and or transient conditions. Pre-heating of static components can improve start time and performance during transient conditions.

Thermal blankets have been employed in order to keep casings warm while a gas turbine engine is idle. However, this can require constant heat application and are relatively slow.

SUMMARY

Briefly described, aspects of the present disclosure relate to induction heating of gas turbine components.

An aspect of the present disclosure may be a system for inductively heating a component of a gas turbine engine. The gas turbine engine may comprise a gas turbine engine induction system for inductively heating a component of a gas turbine engine comprising: an induction heater located proximate to a static component of the gas turbine engine; and wherein the induction heater is adapted to heat the static component prior to ignition and during transient conditions so as to reduce a thermal difference between the static component and at least one other component of the gas turbine engine.

Another aspect of the present disclosure may be an induction heater for a gas turbine engine. The induction heater may have a coil adapted to surround a static component of the gas turbine engine; and an electric component for transmitting electricity through the coil surrounding the static component, the transmission of electricity heats the static component so as to heat the static component prior to ignition and during transient conditions so as to reduce a thermal difference between the static component and at least one other component of the gas turbine engine.

Still yet another aspect of the present invention may be a method for inductively heating a component of a gas turbine engine. The method may comprise inductively heating a component of a gas turbine engine comprising: inductively heating a static component prior to ignition of the gas turbine engine and during a transient condition; and reducing a thermal difference between the static component and at least one other component of the gas turbine engine through the inductive heating of the static component.

DETAILED DESCRIPTION

To facilitate an understanding of embodiments, principles, and features of the present disclosure, they are disclosed hereinafter with reference to implementation in illustrative embodiments. Embodiments of the present disclosure, however, are not limited to use in the described systems or methods and may be utilized in other systems and methods as will be understood by those skilled in the art.

The components described hereinafter as making up the various embodiments are intended to be illustrative and not restrictive. Many suitable components that would perform the same or a similar function as the components described herein are intended to be embraced within the scope of embodiments of the present disclosure.

Figure 1:
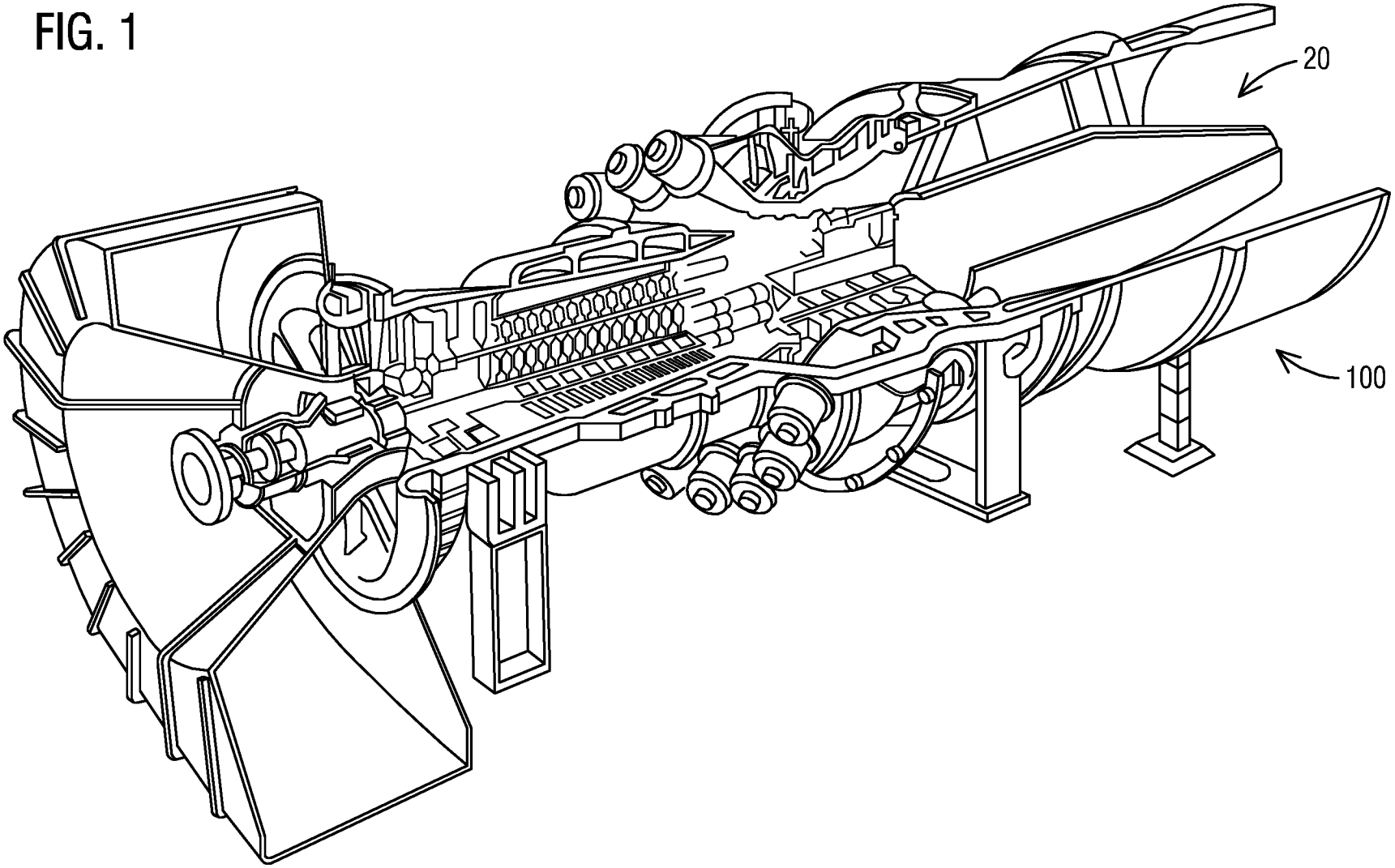
FIG. 1 is a cross-sectional view of a gas turbine engine.

FIG. 1 shows a gas turbine engine 100. The gas turbine engine 100 has static component 20. In the example shown in FIG. 1, the static component 20 is a casing.

Figure 2:
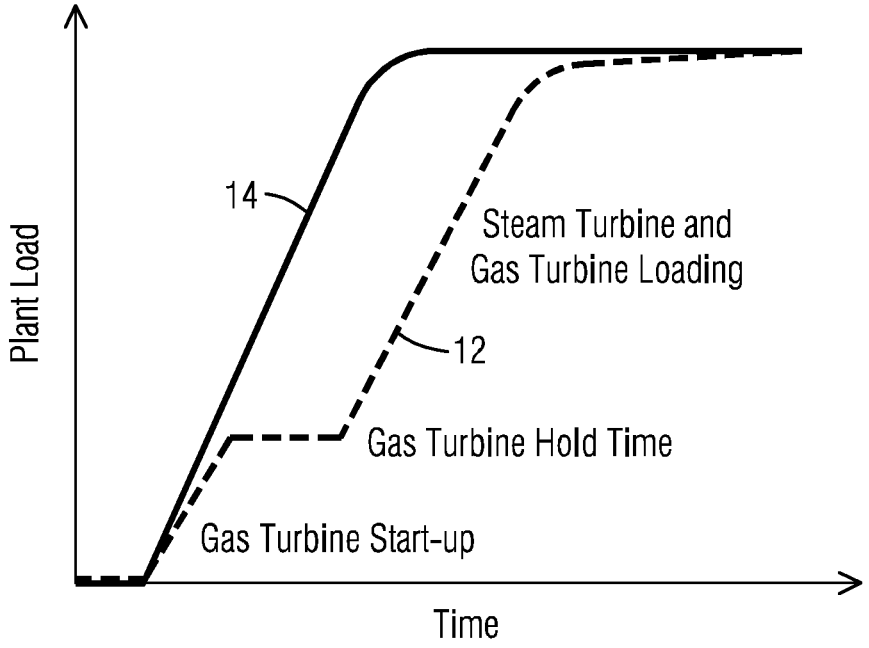
FIG. 2 is a graph illustrating the performance of the gas turbine engine when the components are inductively heated prior to ignition and during transient conditions.

FIG. 2 is a graph illustrating the performance of the gas turbine engine 100 when the static component 20 is inductively heated prior to ignition and during transient conditions. The time prior to ignition can be that period of time that is immediately preceding ignition to some period before the ignition. For example, the induction heating can occur five minutes prior to the ignition of the gas turbine engine 100. It should be understood that the induction heating occurs in manner that is preferably synchronized with the intended temperatures anticipated by the gas turbine engine 100 in order to meet the energy needs required.

Transient conditions are those conditions in the gas turbine engine 100 wherein the gas turbine engine 100 is ramping up or down. For example, during ignition, acceleration, deceleration and cool down. For the purposes of the present application the application of the induction heating occurs during the period of time from pre-ignition up until the obtainment of the steady-state condition wherein the gas turbine engine 100 is simply running at a steady rate.

Still referring to FIG. 2, the line 12 illustrates the starting and stopping of the gas turbine engine 100 as it ramps up. The starting and stopping of the gas turbine engine 100 as illustrated in line 12 hinders the operation of the gas turbine engine 100. However, without pre-heating, the staged ramp up of the gas turbine engine 100 is desirable so as to prevent material distress from impacting the components of the gas turbine engine 100 and thus adversely impacting the components life span. The staged ramp up illustrated by line 12 impacts the ability of a gas turbine engine 100 to supply sufficient energy during times when a quick supply of energy is needed.

The line 14 illustrates the smooth operation of the gas turbine engine 100 that occurs due to the inductive heating of a static component 20, such as the casing, prior to ignition and during transient conditions. With the inductive heating the gas turbine engine can ramp up quick and be able to supply the energy in a faster manner than if there was no inductive heating.

Figure 3:
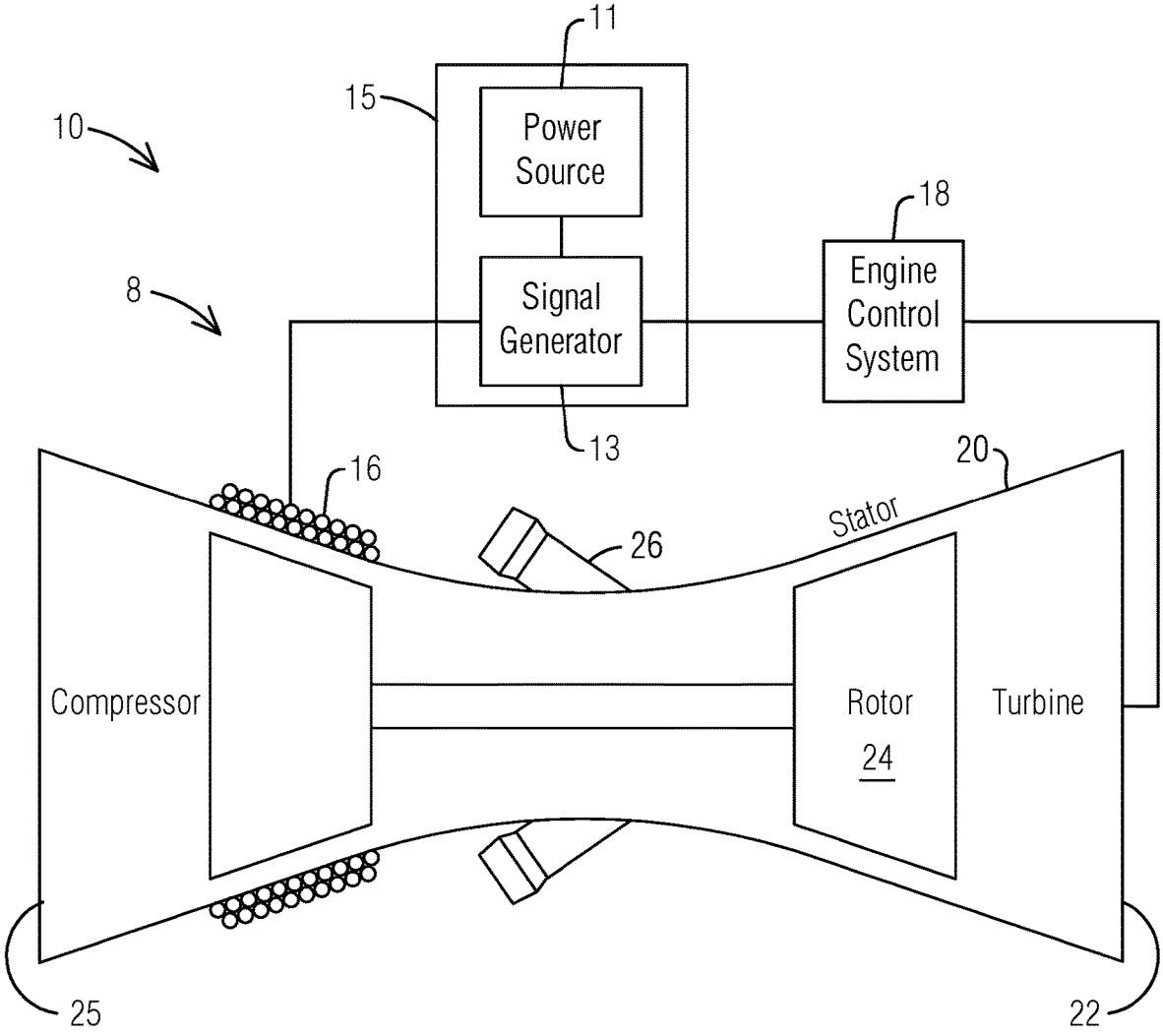
FIG. 3 is a diagram illustrating the system for implementation of induction heating pre-ignition and the transient conditions of the gas turbine engine.

Referring now to FIG. 3, a gas turbine engine induction system 10 is shown that provides the induction heating of gas turbine engine components. Induction heating is the process of heating an electrically conducting component by electromagnetic induction, via heat generated within the object by eddy currents.

The gas turbine engine induction system 10 is installed on a gas turbine engine 100. The gas turbine engine 100 has a static component 20. For purposes of discussion the static component 20 discussed herein is a casing. However it should be understood that the static component 20 may be a stator or casings.

The gas turbine engine 100 also comprises a turbine 22, a rotor 24, a compressor 25 and a combustor 26. The gas turbine engine 100 also comprises an engine control system 18. The engine control system 18 may be operatively connected to components within the gas turbine engine induction system 10. The engine control system 18 may supply feedback and signals so as harmonize the application of induction heating with the ramp up of the gas turbine engine 100.

The gas turbine engine induction system 10 employs an induction heater 8. An induction heater 8 generally comprises components that operate as an electromagnet that has an electronic oscillator that passes a high-frequency alternating current (AC) through the electromagnet. The rapidly alternating magnetic field penetrates the component to be heated thereby generating electric currents inside the component called eddy currents. The eddy currents flowing through the resistance of the material heat it by Joule heating. In ferromagnetic materials like iron, heat may also be generated by magnetic hysteresis losses. A feature of the induction heating process is that the heat is generated inside the object itself, instead of by an external heat source via heat conduction. Thus components can be heated very rapidly. Additionally there does not need to be any external contact via a heating component.

In FIG. 3, the induction heater 8 comprises an induction coil 16 and an electric component 15. The electric component 15 comprises a power source 11 and signal generator 13. The power source 11 and the signal generator 13 provide electric current to the induction coil 16. The provision of the electric current to the induction coil 16 will generate heat within an electrically conductive target component, in this instance static component 20.

Still referring to FIG. 3, the induction coil 16 is placed around the static component 20. The induction coil 16 may vary in terms of spacing between each loop of the coil and the number of coil. This variation impacts the manner in which the static component 20 is heated. The induction coil 16 may be made of glass covering and steel and copper wires interior.

Applying induction heating via the induction heater 8 to static component 20 is a way to quickly heat the static components 20 to a temperature that would offer a benefit for start time and/or transient flexibility. This requires an induction coil 16 appropriately sized and wrapped around the static component 20 with appropriate spacing for the induction coil 16. The correct current and voltage are then set to deliver the desired electromagnetic induction to achieve the required temperature for the static component 20. A similar solution could be applied to steam turbines.

The control of current to the induction coil 16 can be harmonized with the engine control system 18 to minimize response time. In other words, the engine control system 18 can be connected to the electric component 15 in order to provide signals via the signal generator 13 that indicate that the electric signals should be transmitted so as to correspond with the pre-ignition and transient conditions of the gas turbine engine 100.

The provision of signals via the signal generator 13 during the appropriate times ensures that the target static component 20 reaches the desired temperature when the control system 18 detects the need for a transient condition, such as acceleration, the electric component 15 transmits current to the induction coil 16. The induction coil 16 will cause the static component 20 to heat up. Preferably, the heating of the static component 20 can be such that ramp up and provision of energy can be steady. Furthermore, preferably the heating of the static component 20 should be such that the temperature differential between the static component 20 and at least one other component is minimal. By minimal it is meant that the temperature differential is less than 20° C. Preferably the temperature differential is less than 5° C.

The temperature of the static component 20 can be monitored with sensors. Alternatively the temperature of the static component 20 can be mapped based on previous measurements of the temperature of the static component 20 based on previous applications of current through the induction coil 16.

Figure 4:
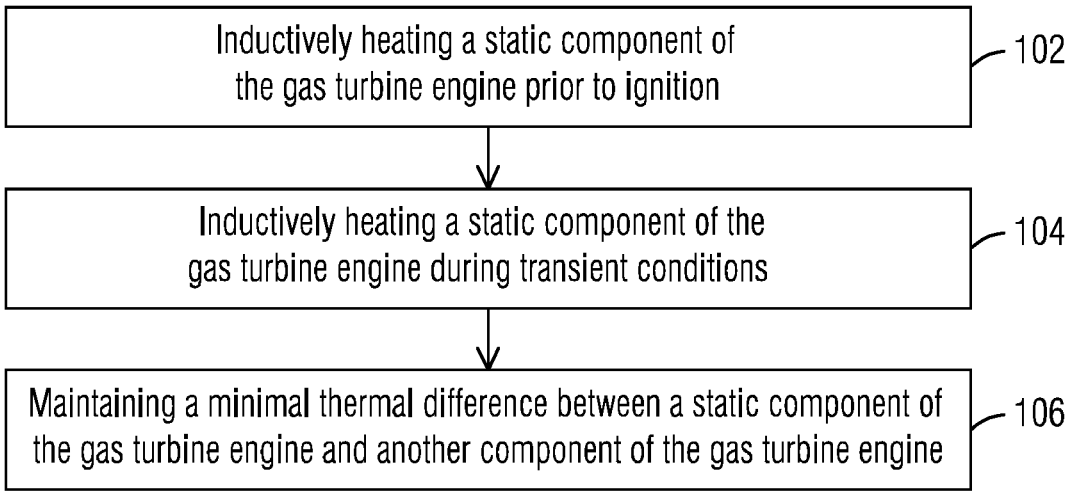
FIG. 4 is a flow chart setting forth the method for implementation of induction heating during pre-ignition and transient conditions of the gas turbine engine.

Referring to FIG. 4, the method for inductively heating a static component 20 of a gas turbine engine 100 during pre-ignition and transient conditions is shown. In step 102, the static component 20 is inductively heated prior to ignition of the gas turbine engine 100. The inductive heating prior to the ignition of the gas turbine engine 100 brings the temperature of the static component 20 close to the temperature that the gas turbine engine 100 will be at ignition.

In step 104, the static component 20 will be inductively heated during a transient condition, such as acceleration, in order to minimize the thermal differential between the static component 20 and the other components of the gas turbine engine 100.

In step 106, a minimal thermal differential between a static component 20 and another component of the gas turbine engine 100 is maintained. This can be accomplished by inductively heating the static component 20 during the operation.

The maintenance of the temperature differential may be achieved by starting and ceasing the inductive heating of the static component 20. This may occur periodically so as to maintain a substantially uniform thermal differential. By substantially uniform thermal differential it is meant that the thermal differential is preferably less than 10° C. Preferably, this uniform thermal differential is maintained during the operation of the gas turbine engine 100.

The thermal differential can be determined actively based upon sensor measurements of static component 20 and another component of the gas turbine engine. Preferably the other component of the gas turbine engine 100 is a component that generally experiences greater heat during operation, such as components in the gas path. Based upon the measurements the application of the inductive heating may be started, ceased, or altered in some fashion (i.e. increased or decreased current so as to impact the heating of the static component 20).

Alternatively, the thermal difference can be determined passively based upon the known behaviour of the gas turbine engine 100. The electric component 15 can be programmed in conjunction with the engine control system 18 to perform predetermined application of the induction heating during the operation of the gas turbine engine 100.

Induction heating allows for a faster ramp up speed of the gas turbine engine 100 than other solutions. It may offer lower capital costs than material solutions. In addition to being applied as a new feature, existing engines may be retrofitted.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. An induction heater for a gas turbine engine comprising:

a coil adapted to surround a static component of the gas turbine engine;

a power source that is configured to supply electricity to the coil surrounding the static component to heat the static component prior to ignition and during transient conditions; and a signal generator configured to control the power source to start and cease supplying electricity to the coil to maintain a uniform thermal difference between the static component and at least one other component of the gas turbine engine through the inductive heating of the static component during operation of the gas turbine engine, wherein the uniform thermal difference varies by less than 10° C.

2. The induction heater of claim 1, wherein the static component of the gas turbine engine is a casing.

3. A method for inductively heating a component of a gas turbine engine comprising:

inductively heating a static component prior to ignition of the gas turbine engine and during a transient condition; and maintaining a uniform thermal difference between the static component and at least one other component of the gas turbine engine through the inductive heating of the static component during operation of the gas turbine engine, wherein the uniform thermal difference varies by less than 10° C.

4. The method of claim 3, wherein the step of inductively heating is performed by an induction heater located proximate to the static component of the gas turbine engine.

5. The method of claim 3, wherein the step of maintaining the uniform thermal difference comprises starting and ceasing inductively heating the static component during the operation of the gas turbine engine.

6. The method of claim 3, wherein the step of inductively heating the static component comprises supplying current to an induction heater comprising coils surrounding the static component of the gas turbine engine.

* * * * *